US008356657B2

(12) United States Patent
Zhao et al.

(10) Patent No.: US 8,356,657 B2
(45) Date of Patent: Jan. 22, 2013

(54) HEAT PIPE SYSTEM

(75) Inventors: Yuan Zhao, Thousand Oaks, CA (US); Chung-Lung Chen, Thousand Oaks, CA (US)

(73) Assignee: Teledyne Scientific & Imaging, LLC

( * ) Notice: Subject to any disclaimer, the term of this patent is extended or adjusted under 35 U.S.C. 154(b) by 1289 days.

(21) Appl. No.: 11/960,480

(22) Filed: Dec. 19, 2007

(65) Prior Publication Data

US 2009/0159242 A1 Jun. 25, 2009

(51) Int. Cl.

| | |
|---|---|
| ***F28D 15/00*** | (2006.01) |
| ***B32B 1/00*** | (2006.01) |
| ***B32B 1/04*** | (2006.01) |
| ***B32B 1/06*** | (2006.01) |

(52) U.S. Cl. ..... 165/104.26; 428/34.4

(58) Field of Classification Search ..... 165/104.26; 428/34.4

See application file for complete search history.

(56) References Cited

U.S. PATENT DOCUMENTS

| | | | | |
|---|---|---|---|---|
| 4,106,188 | A | 8/1978 | Sekhon et al. | |
| 4,602,679 | A | 7/1986 | Edelstein et al. | |
| 4,697,205 | A | 9/1987 | Eastman | |
| 4,838,347 | A * | 6/1989 | Dentini et al. | 428/329 |
| 5,002,122 | A | 3/1991 | Sarraf et al. | |
| 5,317,255 | A * | 5/1994 | Suyama et al. | 324/755.09 |
| 5,443,876 | A * | 8/1995 | Koskenmaki et al. | 428/41.3 |
| 5,522,962 | A * | 6/1996 | Koskenmaki et al. | 156/272.4 |
| 5,653,280 | A * | 8/1997 | Porter | 165/185 |
| 5,769,154 | A * | 6/1998 | Adkins et al. | 165/104.26 |
| 5,947,193 | A * | 9/1999 | Adkins et al. | 165/104.26 |
| 6,056,044 | A * | 5/2000 | Benson et al. | 165/104.26 |
| 6,864,571 | B2 | 3/2005 | Arik et al. | |
| 6,997,245 | B2 | 2/2006 | Lindemuth et al. | |
| 7,002,247 | B2 | 2/2006 | Mok et al. | |
| 7,028,759 | B2 * | 4/2006 | Rosenfeld et al. | 165/104.26 |
| 7,115,444 | B2 * | 10/2006 | Yoshimura | 438/122 |
| 7,180,179 | B2 | 2/2007 | Mok et al. | |
| 7,237,337 | B2 | 7/2007 | Yeh et al. | |
| 7,246,655 | B2 | 7/2007 | Mochizuki et al. | |
| 7,381,592 | B2 * | 6/2008 | Yoshimura | 438/122 |
| 7,438,563 | B2 * | 10/2008 | Chung et al. | 439/91 |
| 7,538,422 | B2 | 5/2009 | Dangelo et al. | |
| 7,540,319 | B2 * | 6/2009 | Mochizuki et al. | 165/104.26 |
| 7,609,520 | B2 | 10/2009 | Chang et al. | |
| 7,815,998 | B2 * | 10/2010 | Simpson et al. | 428/317.9 |
| 7,907,410 | B2 * | 3/2011 | Martin et al. | 361/708 |
| 8,074,706 | B2 * | 12/2011 | Su et al. | 165/104.26 |
| 8,202,588 | B2 * | 6/2012 | Keller et al. | 428/34.4 |
| 8,216,661 | B2 * | 7/2012 | Kelly et al. | 428/141 |
| 8,235,096 | B1 * | 8/2012 | Mahefkey et al. | 165/104.26 |

(Continued)

OTHER PUBLICATIONS

U.S. Appl. No. 11/977,251, filed Aug. 27, 2010, Advisory Action.

(Continued)

*Primary Examiner* — Ljiljana Ciric

(57) ABSTRACT

A lattice wick system has a plurality of granular wicking walls configured to transport liquid through capillary action in a first direction, each set of the plurality of granular wicking walls forming respective vapor vents between them to transport vapor. Granular interconnect wicks are embedded between respective pairs of the granular wicking walls to transport liquid through capillary action in a second direction substantially perpendicular to the first direction. The granular interconnect wicks have substantially the same height as said granular wicking wall so that the plurality of granular wicking walls and granular interconnect wicks enable transport of liquid through capillary action in two directions and the plurality of vapor vents transport vapor in a direction orthogonal to the first and second directions.

10 Claims, 7 Drawing Sheets

U.S. PATENT DOCUMENTS

| | | | | |
|---|---|---|---|---|
| 8,243,449 | B2 * | 8/2012 | Oniki et al. | 165/104.26 |
| 8,246,902 | B2 * | 8/2012 | Hou | 165/104.26 |
| 8,257,809 | B2 * | 9/2012 | Morrison et al. | 428/34.4 |
| 2005/0126766 | A1 | 6/2005 | Lee et al. | |
| 2005/0145367 | A1 | 7/2005 | Hannah et al. | |
| 2005/0238810 | A1 | 10/2005 | Scaringe et al. | |
| 2006/0001136 | A1 | 1/2006 | Tao et al. | |
| 2006/0124281 | A1 * | 6/2006 | Rosenfeld et al. | 165/104.26 |
| 2006/0196640 | A1 | 9/2006 | Siu | |
| 2007/0068654 | A1 | 3/2007 | Chang | |
| 2007/0099311 | A1 | 5/2007 | Zhou et al. | |
| 2007/0158052 | A1 | 7/2007 | Lin | |
| 2008/0174963 | A1 | 7/2008 | Chang et al. | |
| 2009/0085198 | A1 | 4/2009 | Vadakkanmaruveedu et al. | |
| 2009/0159242 | A1 | 6/2009 | Zhao et al. | |

OTHER PUBLICATIONS

U.S. Appl. No. 11/977,251, filed Aug. 16, 2010, Amendment Ater Final.

U.S. Appl. No. 11/977,251, filed Jun. 14, 2010 Final Office Action.

U.S. Appl. No. 11/977,251, filed Apr. 26, 2010 Amendment after non-final rejection.

U.S. Appl. No. 11/977,251, filed Jan. 8, 2010, Amendment entered with RCE.

U.S. Appl. No. 11/977,251, filed Jun. 5, 2009, Amendment after non-final rejection.

Sauciuc, et al., Spreading in the Heat Sink Base: Phase Change Systems or Solid Metals??, IEEE Trans. on Components and Packaging Technologies, vol. 25, No. 4, Dec. 2002.

Lee, How to Select a Heat Sink, Electronics Cooling magazine, Jun. 1995, available online at: http://electronics-cooling.com/articles/1995/jun/jun95_01.php.

Gillot, et al., Silicon Heat Pipes Used as Thermal Spreaders, IEEE Trans. on Components and Packaging Technologies, vol. 26, No. 2, pp. 332-339, Jun. 2003.

Ponnappan, A Novel Micro-Capillary Groove-Wick Miniature Heat Pipe, Energy Conversion Engineering Conference and Exhibit 2000, 35th Intersociety, vol. 2, pp. 818-826, Jul. 24-28, 2000.

Lai, et al., Thermal Characterization of Flat Silicon Heat Pipes, 20th Annual IEEE Semiconductor Thermal Measurement and Management Symposium, pp. 21-25, Mar. 9-11, 2004.

USPTO, U.S. Appl. No. 11/977,251, Office Action, mailed Aug. 11, 2009, 7 pages.

USPTO, U.S. Appl. No. 11/977,251, Office Action, mailed Mar. 5, 2009, 11 pages.

Peterson, G.A., "*An Introduction to Heat Pipes", John Wiley & Sons, Inc.*, Ch 1, p. 1-9; Ch 3, p. 44-49; Ch 4, p. 98-99; Ch 7, p. 241-259 (1994).

Zhao, Y & Chen, C.L., An Experimental Investigation of a High Performance Vapor Chamber for High Heat Flux Applications, Abstract, *ASME Submittal* (Jul. 2007).

Zhao, Yuan and Chen, Chung-Lung, "An Investigation of Evaporation Heat Transfer in Sintered Copper Wicks With Microgrooves", *International Mechanical Engineering Congress and Exposition*, p. 1-5 (Nov. 5, 2006).

* cited by examiner

FIG. 3
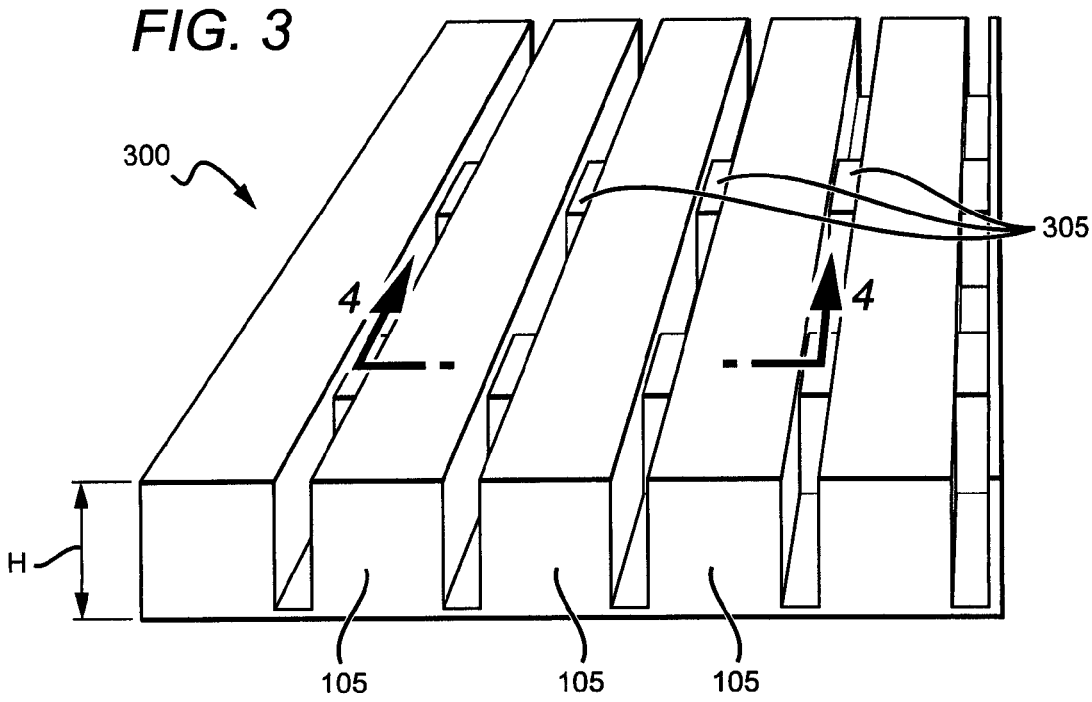
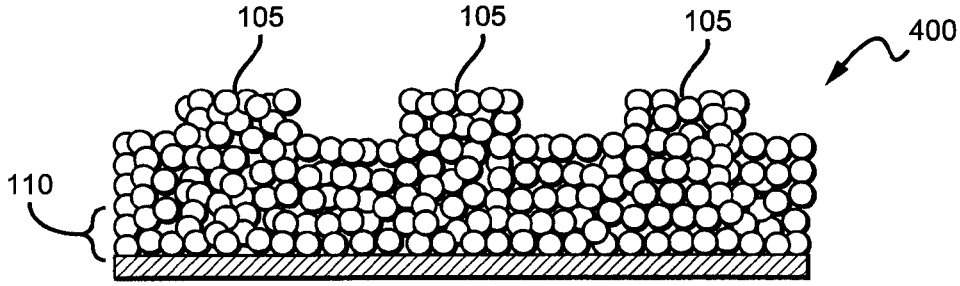
FIG. 4
FIG. 7
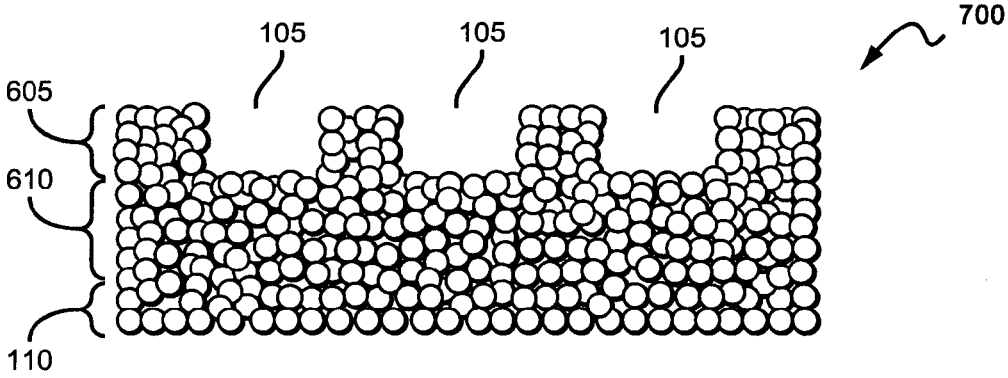

HEAT PIPE SYSTEM

BACKGROUND OF THE INVENTION

1. Field of the Invention

This invention relates to heat sinks, and particularly to heat pipes.

2. Description of the Related Art

Semiconductor systems such as laser diode arrays, compact motor controllers and high power density electronics increasingly require high-performance heat sinks that typically rely on heat pipe technology to improve their performance. Rotating and revolving heat pipes, micro-heat pipes and variable conductant heat pipes may be used to provide effective conductivity higher than that provided by pure metallic heat sinks. Typical heat pipes that use a two-phase working fluid in an enclosed system consist of a container, a mono-dispersed or bi-dispersed wicking structure disposed on the inside surfaces of the container, and a working fluid. Prior to use, the wick is saturated with the working liquid. When a heat source is applied to one side of the heat pipe (the "contact surface"), the working fluid is heated and a portion of the working fluid in an evaporator region within the heat pipe adjacent the contact surface is vaporized. The vapor is communicated through a vapor space in the heat pipe to a condenser region for condensation and then pumped back towards the contact region using capillary pressure created by the wicking structure. The effective heat conductivity of the vapor space in a vapor chamber can be as high as one hundred times that of solid copper. The wicking structure provides the transport path by which the working fluid is recirculated from the condenser side of the vapor chamber to the evaporator side adjacent the heat source and also facilitates even distribution of the working fluid adjacent the heat source. The critical limiting factors for a heat pipe's maximum heat flux capability are the capillary limit and the boiling limit of the evaporator wick structure. The capillary limit is a parameter that represents the ability of a wick structure to deliver a certain amount of liquid over a set distance and the boiling limit indicates the maximum capacity before vapor is generated at the hot spots blankets the contact surfaces and causes the surface temperature of the heat pipe to increase rapidly.

Two countervailing design considerations dominate the design of the wicking structure. A wicking structure consisting of sintered metallic granules is beneficial to create capillary forces that pump water towards the evaporator region during steady-state operation. However, the granular structure itself obstructs transport of vapor from the evaporator region to the condenser region. Unfortunately, conventional heat pipes can typically tolerate heat fluxes less than 80 $W/cm^2$. This heat flux capacity is too low for high power density electronics that may generate hot spots with local heat fluxes on the order of 100-1000 $W/cm^2$. The heat flux capacity of a heat pipe is mainly determined by the evaporator wick structures.

A need still exists for a heat pipe with increased capillary pumping pressure with better vapor transport to the condenser to enable higher local heat fluxes.

SUMMARY OF THE INVENTION

A lattice wick apparatus includes a plurality of granular wicking walls configured to transport liquid through capillary action in a first direction, each set of the plurality of granular wicking walls forming respective vapor vents between them to transport vapor, and a plurality of granular interconnect wicks embedded between respective pairs of said plurality of granular wicking walls to transport liquid through capillary action in a second direction substantially perpendicular to said first direction, with the granular interconnect wicks having substantially the same height as said the wicking walls. The plurality of granular wicking walls and said granular interconnect wicks enable transport of liquid through capillary action in two directions and the plurality of vapor vents transport vapor in direction orthogonal to said first and second directions.

A method of forming a latticed wick structure includes filing an interior portion of a planar heat spreader enclosure with fine metal particles, pressing a lattice wick structure mold into the fine metal particles, and sintering the fine metal particles so that a sintered lattice wick structure is formed from the fine metal particles.

BRIEF DESCRIPTION OF THE DRAWINGS

The components in the figures are not necessary to scale, emphasis instead being placed upon illustrating the principals of the invention. Like reference numerals designate corresponding parts throughout the different views.

FIG. 3 is a perspective view that has, in one embodiment, non-staggered interconnect wicks formed perpendicular to wicking walls, with said interconnect wicks having a height less than said wicking walls;

FIG. 4 is a cross-section view of the embodiment shown in FIG. 3 along the line 4-4;

FIG. 7 is a cross-section view of the embodiment shown in FIG. 6 along the line 7-7;

DETAILED DESCRIPTION OF THE INVENTION

A lattice wick, in accordance with one embodiment, includes a series of granular wicking walls configured to transport liquid using capillary pumping action in a first direction, with spaces between the wicking walls establishing vapor vents between them. Granular interconnect wicks are embedded between pairs of the wicking walls to transport liquid through capillary pumping action in a second direction. The vapor vents receive vapor migrating out of the granular wicking walls and interconnect wicks for transport in a direction orthogonal to the first and second directions. The system of wicking walls and interconnect wicks enable transport of liquid through capillary action in two different directions, with the vapor vents transporting vapor in third direction orthogonal to the first and second directions. The lattice wick preferably includes pole array extending from the interconnect wicks to support a condenser internal surface and to wick liquid in the direction orthogonal to the first and second directions for transport to the interconnect wicks and wicking walls. Although the embodiments are described as transporting liquid and vapor in vector directions, it is appreciated that such descriptions are intended to indicate average bulk flow migration directions of liquid and/or vapor. The combination of wicking walls, interconnect wicks and vapor vents establish a system that allows vapor to escape from a heated spot without significantly affecting the capacity of the lattice wick to deliver liquid to the hot spot.

Figure 1:
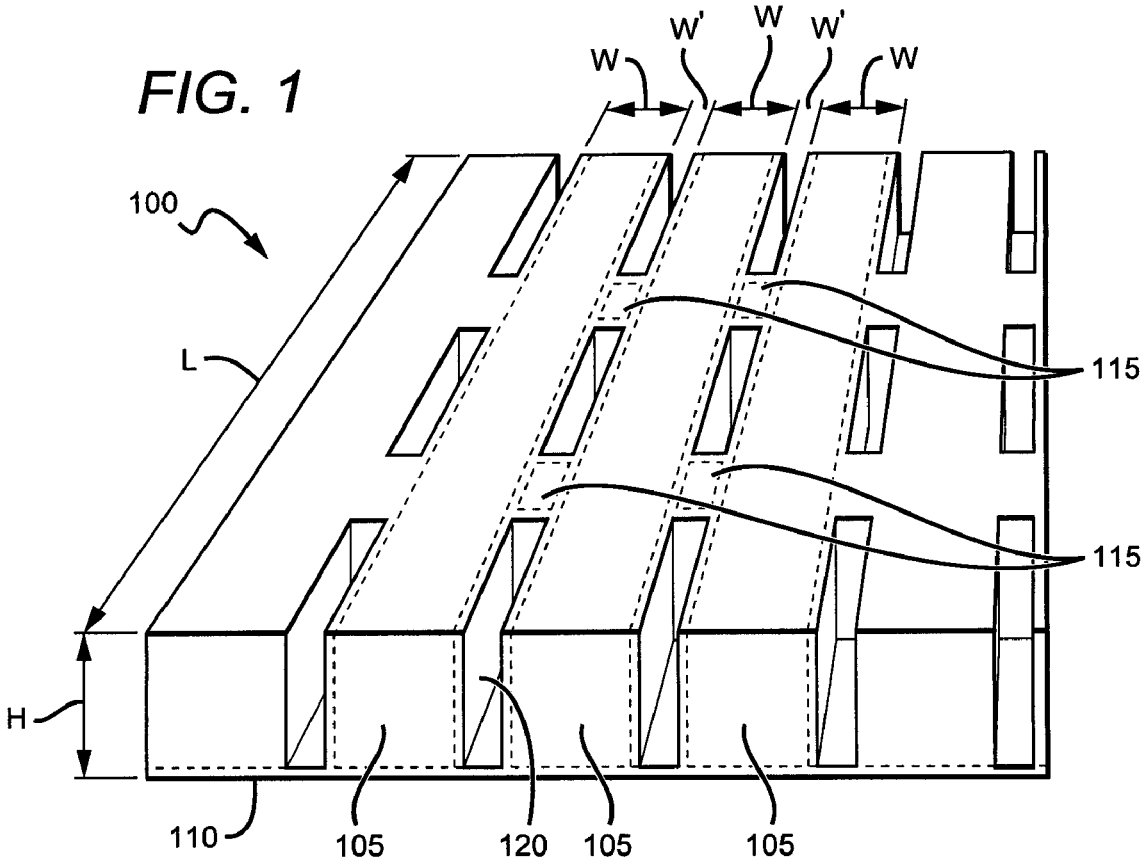
FIG. 1 is a perspective view of a lattice wick that has, in one embodiment, non-staggered interconnect wicks formed perpendicular to parallel-spaced wicking walls.

In one embodiment illustrated in FIG. 1, a wick structure 100 is formed in a fingered pattern with each finger defining parallel wicking walls 105 formed on a wick structure base 110 to communicate a working liquid in a first direction. Length L of each wicking wall 105 is far greater than the width W of each wicking wall 105. The wicking walls 105 are preferably formed in parallel with one another to facilitate their manufacture. Interconnect wicks 115 are formed between and embedded with wicking walls 105 to communicate the working liquid between the wicking walls 105 in a second direction perpendicular to the first direction. The wicking walls 105 and interconnect wicks 115 establish vapor vents 120 between them to transport vapor in a direction orthogonal to the first and second directions during operation.

Although the wicking walls 105 and wick structure base 110 are illustrated in FIG. 1 as solid, they are formed of an open porous structure of packed particles, preferably sintered copper particles that each has a nominal diameter of 50 microns, to enable capillary pumping pressure when introduced to a working fluid. Other particle materials may be used, however, such as stainless steel, aluminum, carbon steel or other solids with reduced reactance with the chosen working fluid. When copper is used, the working fluid is preferably purified water, although other liquids may be used such as such as acetone or methanol. Acceptable working fluids for aluminum particles include ammonia, acetone or various freons; for stainless steel, working fluids include water, ammonia or acetone; and for carbon steel, working fluids include Naphthalene or Toluene. The ratio of wicking walls 105 to interconnect wicks 115 may also be changed to the fluid carrying capacity in the first and second directions, respectively.

In one wick structure designed to provide an enlarged heat flux capacity and improved phase change heat transfer performance, with a sintered copper particle diameter of 50 microns and purified water as a working fluid, the various elements of the wick structure have the approximate length, widths and heights listed in Table 1.

TABLE 1

| | Length | Width | Height |
|---|---|---|---|
| Wicking walls 105 | 10 cm | 150 microns | 1 mm |
| Base 110 | 10 cm | 6 cm | 100 microns |
| Interconnect wicks 115 | 125 microns | 125 microns | 1 mm |
| Vents 120 | 800 microns | 125 microns (W') | 1 mm |

The dimensions of the various elements may vary. For example, vapor vent width W' can range from a millimeter to as small as 50 microns. The width W of each wicking wall 105 is preferably 3-7 times the nominal particle size. Although the wicking walls 105 are described as having a uniform width, they may be formed with a non-uniform width in a non-linear pattern or may have a cross section that is not rectangular, such as a square or other cross section. The wick structure base 100 preferably has a thickness of 1-2 particles. When sintered copper particles are used to form the latticed wick, they may have a diameter in the range of 10 microns to 100 microns. Copper particles having these diameters are commercially available and offered by AcuPowder International, LLC, of New Jersey.

Figure 2:
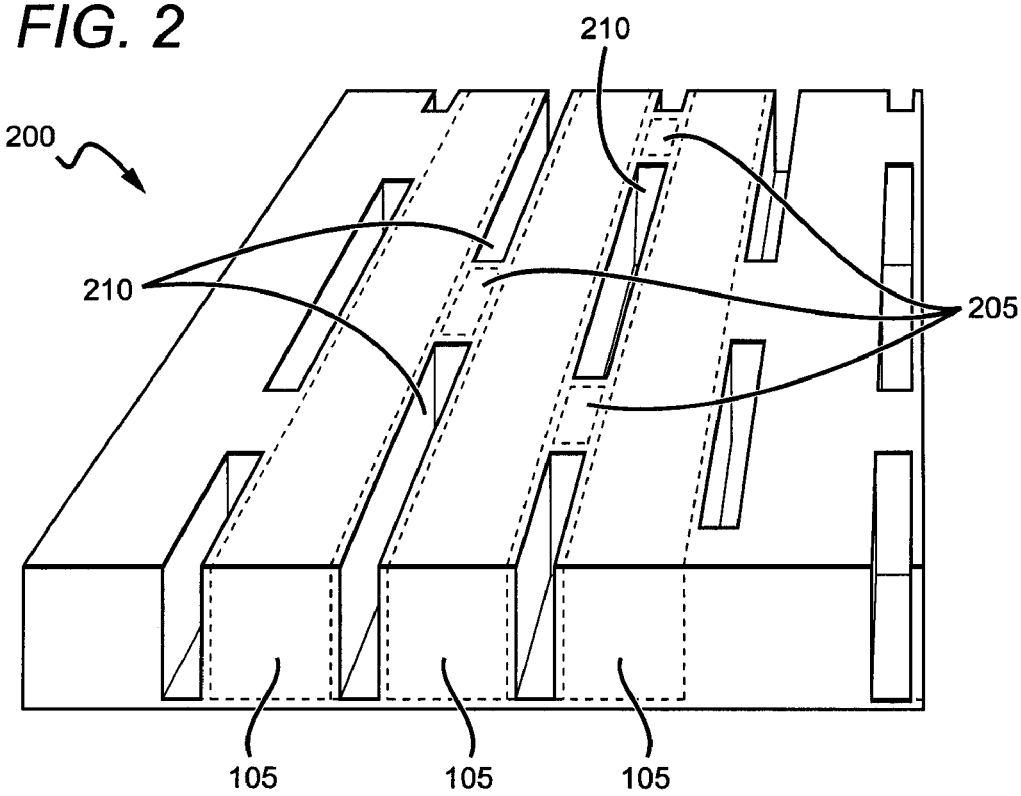
FIG. 2 is a perspective view, in one embodiment, of a lattice wick that has staggered interconnect wicks formed perpendicular to wicking walls spaced in parallel.

FIG. 2 illustrates one embodiment of a lattice wick 200 that has interconnect wicks 205 formed in a staggered position between and embedded with wicking walls 105 to communicate the working fluid between the wicking walls 105 in the second direction perpendicular to the first direction. As in the embodiment illustrated in FIG. 1, the wicking walls 105 and interconnect wicks 205 establish vapor vents 210 between them to transport vapor in a direction orthogonal to the first and second directions during operation. As described above for FIG. 1, the wicking walls 105 and interconnect wicks 205 are formed of an open porous structure of packed particles, preferably centered copper particles that each have a diameter of 15 microns, to enable capillary pumping pressure when introduced to a working fluid.

FIG. 3 illustrates one embodiment that has a wick structure 300 with interconnect wicks 305 which differ in height from wicking walls 105. In the illustrated embodiment, interconnect wicks 305 have a height which is less than the height H of the wicking walls 105. The interconnect wicks 305 may also be staggered in relation to themselves or be formed with differing heights.

The embodiments illustrated in FIGS. 1-3 are formed of homogenous and sintered packed particles; however, the structures may be formed from the same or different materials to provide differing capillary pumping pressures as between them when introduced to a working fluid. Also, the height H of the wicking walls 105 may be of non-uniform height.

Referring now to FIG. 4, wicking walls 105, wick structure base 110 and wicking supports 405 are preferably formed from packed, centered copper particles 400 that each has a nominal diameter of 50 microns to provide an effective pore radius of approximately 13 microns after sintering. When introduced to a working liquid, the maximum capillary pressure for such a structure operating at a steady state may be expressed as:

$$\Delta P_c = 2\sigma/0.41(r_s)$$

Where $r_s$ equals the nominal particle radius.

To increase the capillary limit and resulting liquid pumping force between the condenser to evaporator regions, a smaller particle diameter would be used. Increasing particle diameter would result in a reduced capillary limit but would decrease vapor pressure drop between the condenser and evaporator regions thus allowing freer movement of vapor to the condenser. The boiling limit (maximum heat flux) can be defined as:

$$q_m = (k_{eff}/T_w)\Delta T_{cr}$$

where $k_{eff}$ is the effective thermal conductivity of the liquid-wick combination. $\Delta T_{cr}$ is the critical superheat, defined as:

$$\Delta T_{cr} = (T_{sat}/\lambda\rho_v)(2\sigma/r_n - \Delta P_{i,m})$$

where $T_{sat}$ is the saturation temperature of the working fluid and $r_n$ is approximated by $2.54\times10^{-5}$ to $2.54\times10^{-7}$ m for conventional metallic heat pipe case materials.

Figure 5:
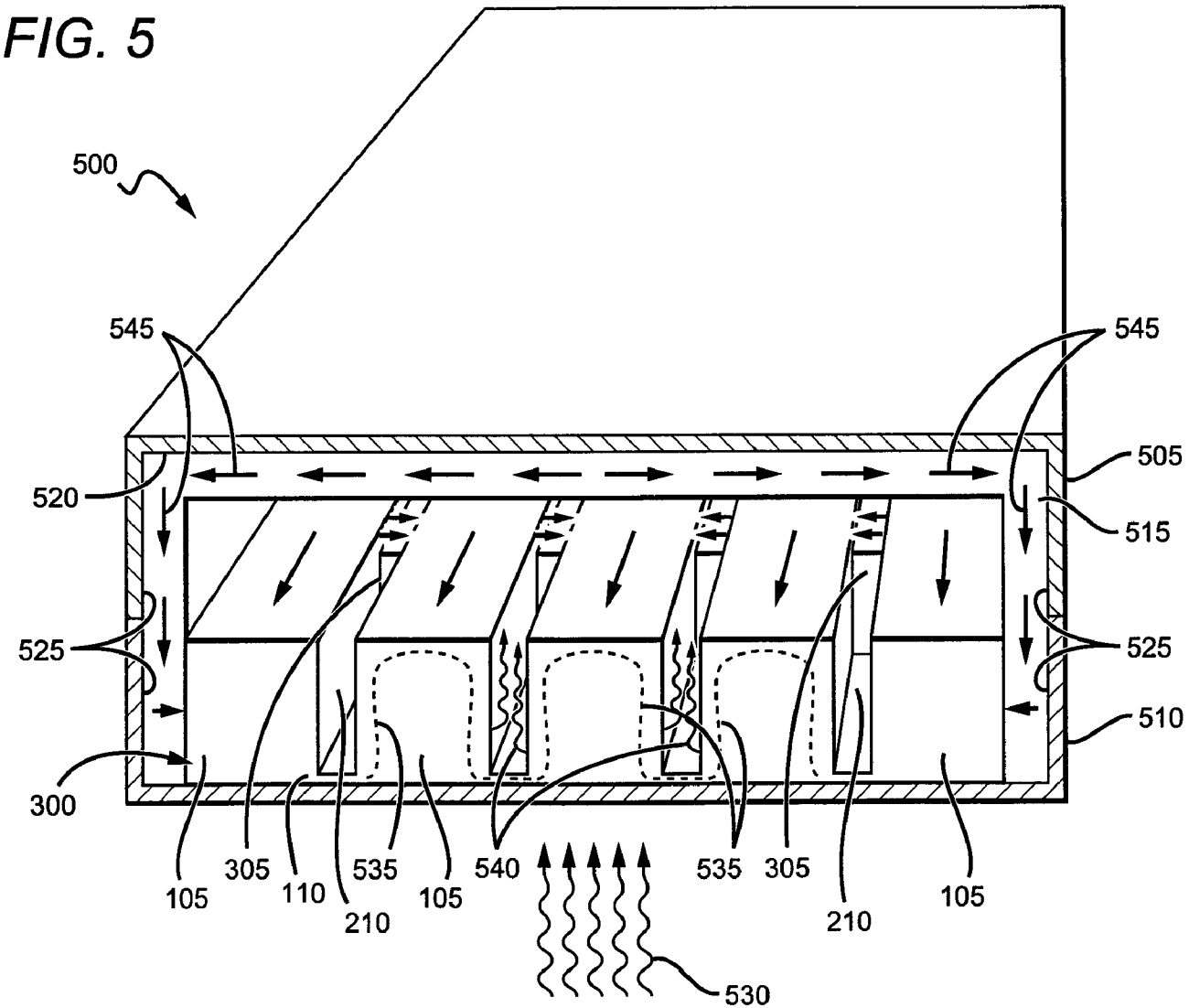
FIG. 5 is a perspective view of one cross-section view of a vapor chamber that has the wick illustrated in FIG. 3 and illustrating vapor and liquid transport during steady-state operation.

FIG. 5 illustrates the wick structure 300 of FIG. 3 seated in upper and lower shells 505, 510. Working fluid (not shown) saturates the wicking walls 105, interconnect wicks 305 and wick structure base 110. A conventional wick 515 is seated on an interior condensation surface (alternatively called the "condenser") portion 520 of the upper shell and on interior vertical faces 525 of the upper and lower shells 505, 510 to establish a heat spreader in the form of vapor chamber 500. The standard wick may be any micro wick, such as that illustrated in U.S. Pat. No. 6,997,245 issued to Lindemuth and such is incorporated by reference. A heat source 530 in thermal communication with one end of the vapor chamber 500 causes the working fluid to heat which causes a small vapor-fluid boundary 535 to form in a portion of the wicking walls 105 adjacent the heat source 530. As vapor 540 escapes from the interior of the wicking walls, it is communicated to the condenser 520, due in part to a pressure gradient existing between the evaporator region and vapor-liquid boundary 535. Upon condensing, the condensed working fluid 545 is captured by the standard wick 515 for transport to wicking walls 105 through interconnect wicks 305 because of capillary pumping action established between the working fluid and sintered particles that preferably comprise the standard wick 515 and that comprise the wicking walls 105 and interconnect wicks 305. The working fluid is transported towards the heat source 530 to replace working fluid vaporized and captured by the vapor vents 210. The heat source 530 may be any heat module that can benefit from the heat sink properties of the vapor chamber 500, such as a laser diode array, a compact motor controller or high power density electronics. The upper and lower metallic shells 505, 510 are coupled together and are each preferably formed of copper, although other materials may be used, such as aluminum, stainless steel, nickel or Refrasil.

Figure 6:
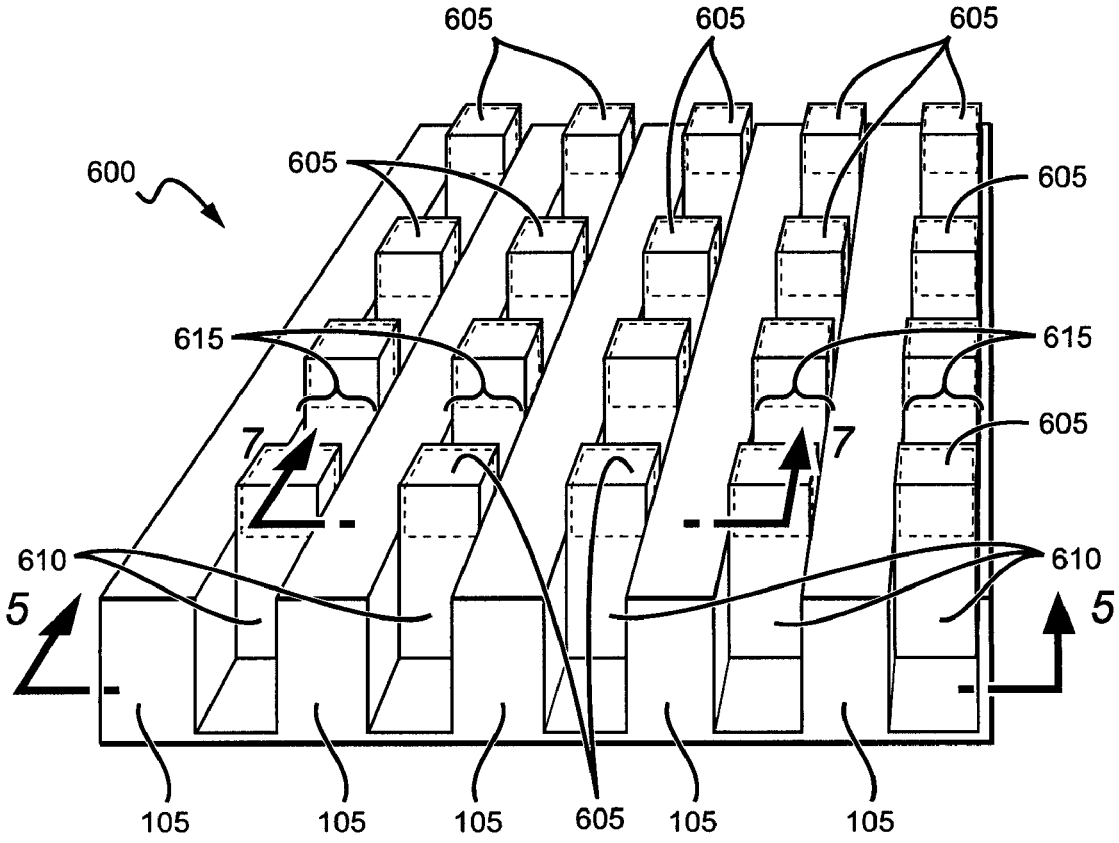
FIG. 6 is a perspective view of a wicking structure that has an array of wicking supports extending away from the wicking structure.

FIG. 6 further illustrates a wick structure 600 that uses the wicking walls 105 of FIG. 1, but with the addition of an array of granular wicking supports 605 extending from an upper surface of respective granular interconnect wicks 610 and away from the interconnect wicks and wicking walls (610, 105). Each interconnect wick 610 preferably has an associated wicking support 605 formed as an extension from it; however, wick structure 600 need not be formed with a wicking support 605 for each interconnect wick 610. The wicking supports 605 provide structural support for a condensation surface of a vapor chamber (not shown) and transport working fluid condensed from vapor on the condensation surface to the wicking walls 105 through interconnect wicks 610. Vapor vents 615 are established between respective pairs of wicking walls 105 and opposing interconnect wicks 610.

FIG. 7 illustrates a cross section view along the line 7-7 in FIG. 6. The packed, centered copper particles 700 each preferably have a nominal diameter of 50 microns to provide an effective pore radius of approximately 13 microns after sintering. Each wick support 605 extends up from its respective interconnect wick 610 to provide structural support for the condensation surface of the vapor chamber and to transport working fluid to the wicking walls 105. The maximum capillary pressure for such a structure operating at a steady state may be expressed as described above for FIG. 4.

Figure 8:
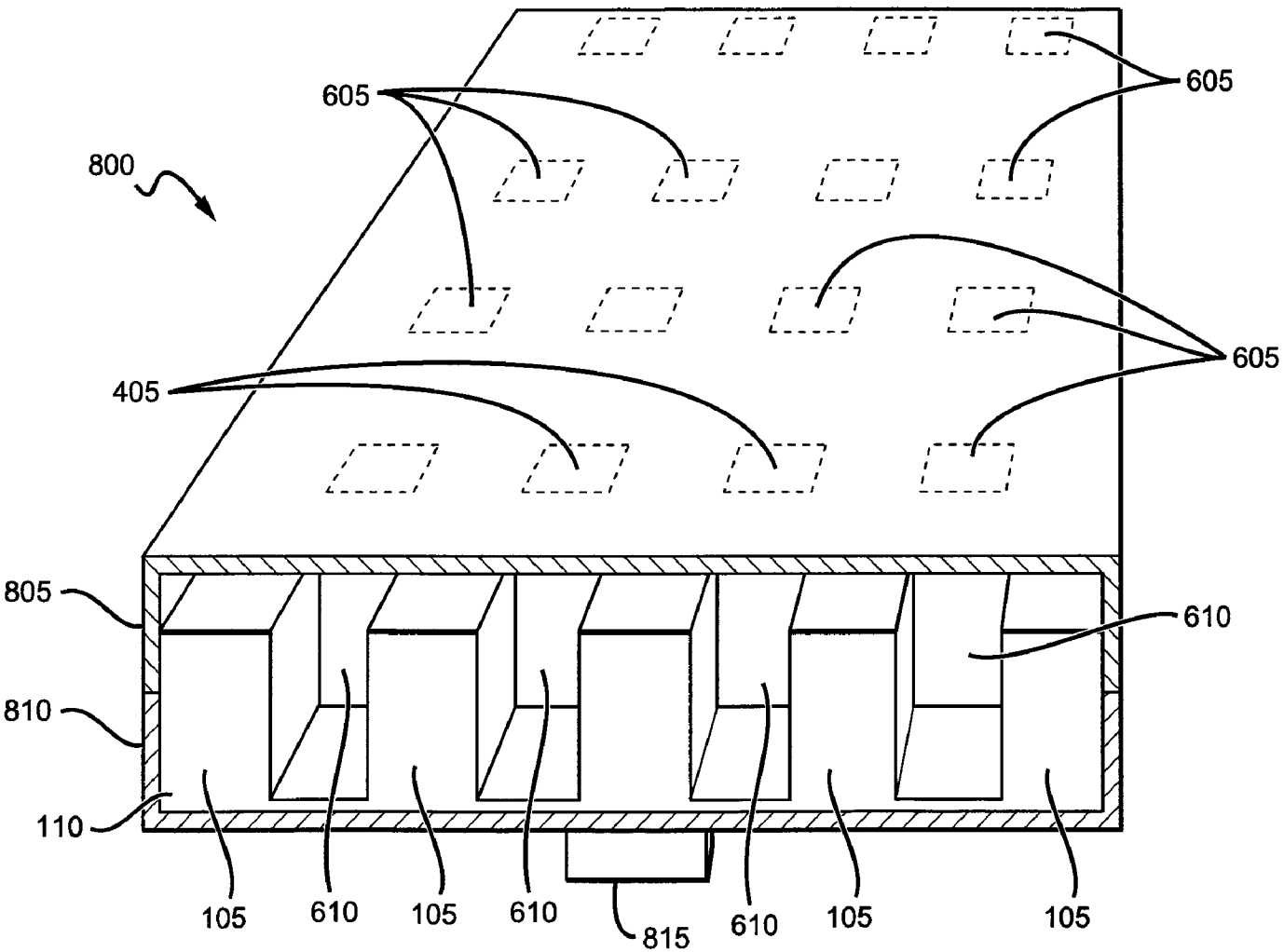
FIG. 8 is a perspective view of one cross-section of a vapor chamber that has the wick illustrated in FIG. 6 disposed within the vapor chamber.

FIG. 8 illustrates the wick structure of FIG. 6 seated in upper and lower shells 805, 810 to establish a vapor chamber 800 upon introduction of a working fluid to saturate the wicking walls 105, interconnect wicks 610 and wick structure base 110. Uppermost faces of wicking supports 605 within the vapor chamber are indicated with dashed lines, with an interior condensation surface (alternatively called the "condenser") portion of the upper shell 805 seated on the uppermost faces of wicking supports 605 for both structural support of the upper shell 805 and so that condensate (working fluid) formed on the condenser is captured by the wicking supports 605. The working fluid is transported to the wicking walls 105 through the interconnect wicks 610 due to capillary pumping action back towards the heat source. The upper and lower metallic shells are coupled together and preferably each formed of copper, although other materials may be used, such as aluminum, stainless steel, nickel or Refrasil. The vapor chamber 800 is in thermal communication with a heat source 815, such as a laser diode array, a high heat flux motor controller, high power density electronics or other heat source that can benefit from the heat sink properties of the vapor chamber 800. The interior surface adjacent the heat source 815 is considered the evaporator, although the vapor-fluid boundary is ideally spaced from the actual evaporator surface during steady-state operation.

Figure 9:
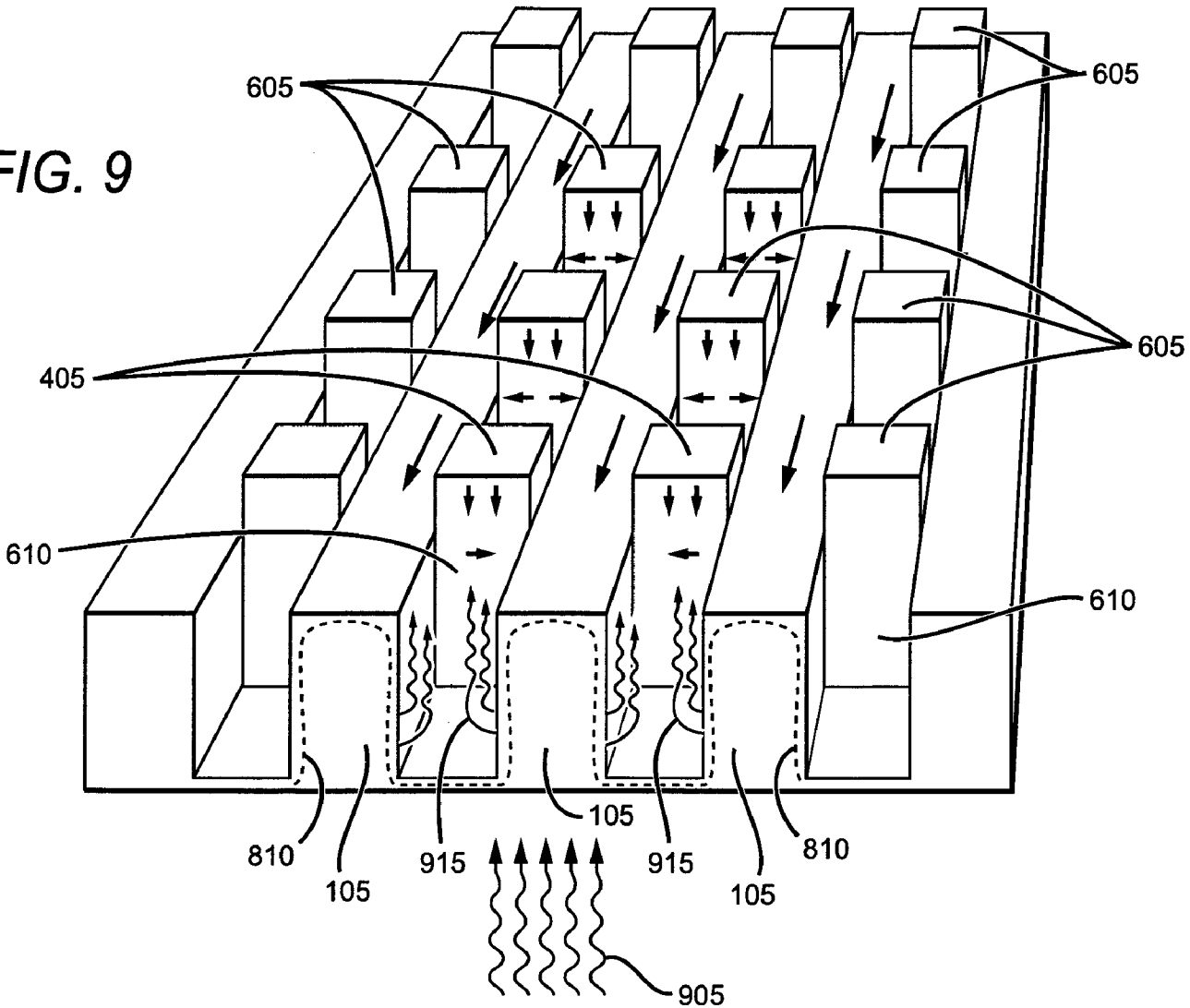
FIG. 9 is a perspective view of the wick illustrated in FIG. 8 with the vapor chamber upper and lower shells removed to better illustrate vapor and fluid flow during steady-state operation.

FIG. 9 shows the flow of liquid and vapor in the vapor chamber illustrated in FIG. 8 during steady-state operation, with the upper and lower shells removed for clarity. As heat 905 is applied to one end of the vapor chamber 800, the working fluid is heated at the evaporator surface adjacent the heat source 905 and a vapor-fluid boundary forms in a portion of the wicking walls 105 as vapor 915 escapes from the interior of the wicking walls 105. The vapor 915 is communicated to the condenser due in part to a pressure gradient existing between the evaporator region and vapor-liquid boundary. Upon condensing, the condensed working fluid is captured by the wicking supports 605 for transport to wicking walls 105 through interconnect wicks 610 due to capillary pumping action established between the working fluid and sintered particles that comprise the wicking supports 605, wicking walls 105 and interconnect wicks 610. The working fluid is transported towards the heat source 905 to replace working fluid vaporized and captured by the vapor vents 615.

Figure 10:
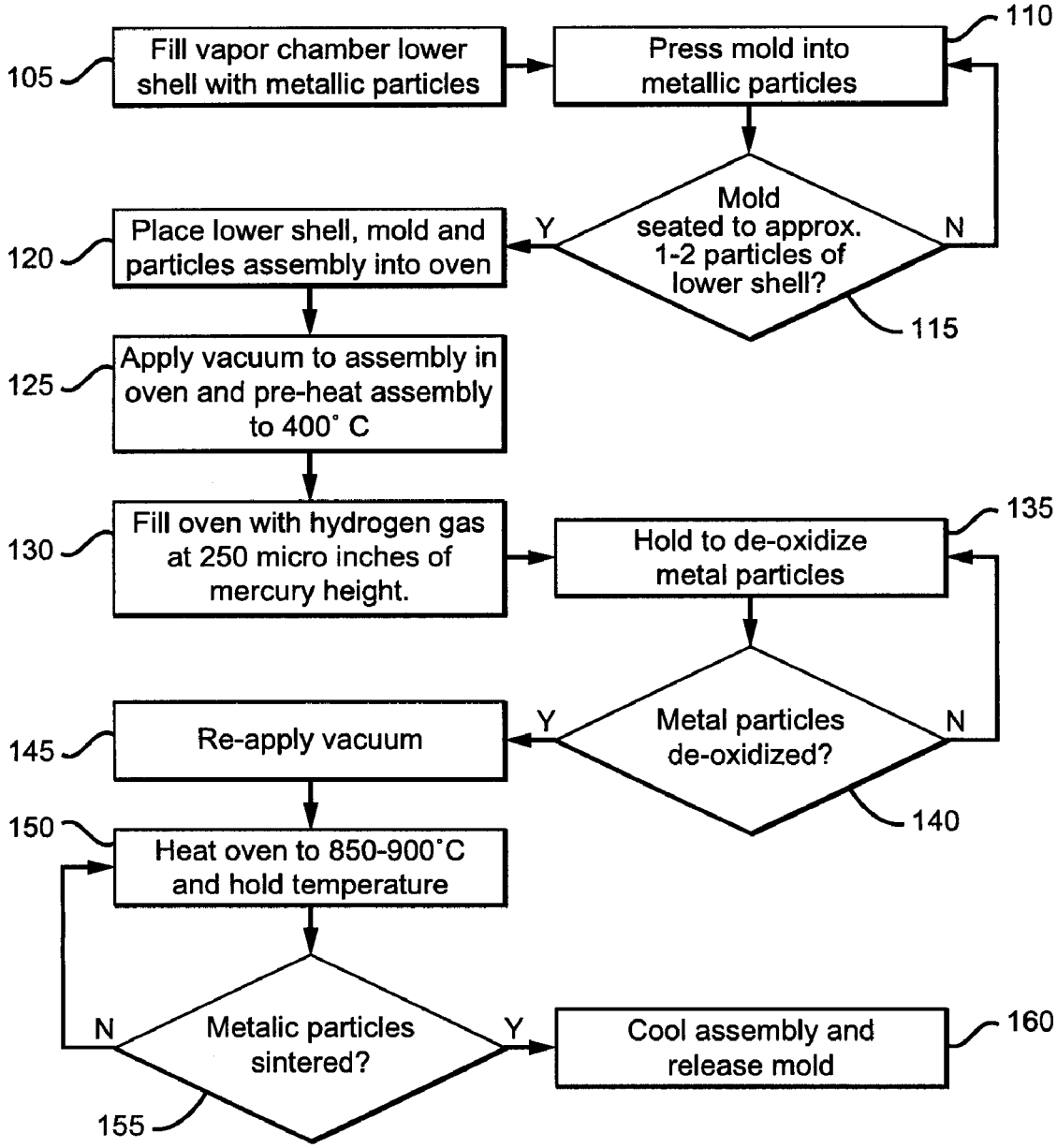
FIG. 10 is a flow diagram describing, in one embodiment, manufacture of the wick illustrated in FIGS. 1-8.

Turning to FIG. 10 that describes manufacture of the lattice wicks illustrated in FIGS. 1-8, the lower shell of a vapor chamber is filled with metallic particles, preferably copper particles (block 105). A wick mold in the form of the desired lattice wick form is pressed into the metallic particles until the mold is seated to within approximately 1-2 copper particles of the lower shell (blocks 110, 115). The assembly comprising the lower shell, mold and particles are introduced into an oven (block 120), the oven is sealed, a vacuum is applied and the oven is heated to an internal temperature of approximately 400° C. (block 125). The oven is then filled with hydrogen gas at preferably 250 micro inches of mercury height (block 130). The assembly is held with the hydrogen gas until a substantial portion of the copper particles are de-oxidized (blocks 135, 140) and a vacuum is then re-applied to remove the hydrogen (block 145). Heat is again applied to increase the internal temperature to 850-900° C. (block 150) until the copper particles are sintered and then the assembly is cooled and the mold released (blocks 155, 160).

While various implementations of the application have been described, it will be apparent to those of ordinary skill in the art that many more embodiments and implementations are possible that are within the scope of this invention.

We claim:

1. A lattice wick apparatus, comprising:

a plurality of granular wicking walls having respective lengths, widths and heights and configured to transport liquid through capillary action in a first direction along the respective lengths, the respective lengths being longer than the respective widths and the respective heights, each of said plurality of granular wicking walls being adjacent to one another and spaced apart to form respective vapor vents between them to transport vapor; and a plurality of granular interconnect wicks embedded between respective pairs of said plurality of granular wicking walls in a second direction substantially perpendicular to the first direction, said plurality of granular interconnect wicks having substantially the same heights as said plurality of granular wicking walls and forming a planar lattice wick surface with said plurality of granular wicking walls;

wherein said planar wick surface is along a plane encompassed by the respective lengths and the respective widths and forms an outer surface of said plurality of granular wicking walls and of said plurality of granular interconnect wicks.

2. The lattice wick apparatus of claim 1, wherein at least one of said plurality of granular interconnect wicks further comprises:

a granular wicking support extending away from said at least one of said plurality of granular interconnect wicks to provide lattice wick structure support and liquid transport.

3. The lattice wick apparatus of claim 1, wherein said plurality of granular wicking walls comprise sintered metal particles.

4. The lattice wick apparatus of claim 1, wherein each of said plurality of granular wicking walls has a rectangular cross section.

5. A lattice wick apparatus, comprising:

a plurality of granular wicking walls having respective lengths, widths and heights and spaced in parallel to transport liquid through capillary action in a first direction, along the respective lengths, the respective lengths being longer than the respective widths and the respective heights, adjacent granular wicking walls spaced apart and forming respective vapor vents between them to transport vapor; and a plurality of granular interconnect wicks embedded between respective pairs of said plurality of granular wicking walls, said plurality of granular interconnect wicks having substantially the same heights as said plurality of granular wicking walls in a second direction;

wherein said plurality of granular wicking walls and said plurality of granular interconnect wicks enable transport of liquid through capillary action in said first and second directions, and said vapor vents transport vapor in a direction orthogonal to said first and second directions.

6. The lattice wick apparatus of claim 5, wherein said plurality of granular wicking walls comprise sintered metal particles.

7. The lattice wick apparatus of claim 6, wherein the width (W) of each of said plurality of granular wicking walls is three through seven times a nominal particle size for said sintered metal particles.

8. The lattice wick apparatus of claim 5, wherein said plurality of granular interconnect wicks are formed in non-staggered positions along and between respective pairs of said plurality of granular wicking walls.

9. The lattice wick apparatus of claim 5, further comprising:

a wick structure extending beneath said plurality of granular wicking walls.

10. The lattice wick apparatus of claim 9, wherein said wick structure comprises a thickness of one through two sintered metal particles.

* * * * *